United States Patent [19]

Oogjen

[11] Patent Number: 5,035,122

[45] Date of Patent: Jul. 30, 1991

[54] PORTABLE CONTAINERS FOR MAINTAINING FOOD STUFFS IN A CHILLED CONDITION

[76] Inventor: Harry W. Oogjen, 409-301 Harbour Point Dr., Virginia Beach, Va. 23451

[21] Appl. No.: 499,642

[22] Filed: Mar. 27, 1990

[51] Int. Cl.[5] ..... F25D 3/08

[52] U.S. Cl. ..... 62/457.2; 62/3.62; 62/430; 62/457.7; 62/457.9

[58] Field of Search ..... 62/457.2, 457.7, 430, 62/457.9, 3.62

[56] References Cited

U.S. PATENT DOCUMENTS

| | | | |
|---|---|---|---|
| 1,042,249 | 10/1912 | Mickelsen | 62/457.7 |
| 1,571,438 | 2/1926 | Schopf | 62/457.2 X |
| 2,400,742 | 5/1946 | Clerc | 62/457.2 X |
| 3,236,206 | 2/1966 | Willinger | 62/457.2 X |
| 3,280,586 | 10/1966 | Funakoshi | 62/457.2 X |
| 3,406,532 | 10/1968 | Rownd et al. | 62/457.2 |
| 4,354,359 | 10/1982 | Hall | 62/457.2 X |
| 4,498,312 | 2/1985 | Schlosser | 62/457.2 |

*Primary Examiner*—Lloyd L. King
*Attorney, Agent, or Firm*—William F. Frank

[57] ABSTRACT

The present invention comprises a container having a top and bottom or two-part form, the outer shell of the container is made of a shock-resistant thermoplastic material having a maximum possible deterrent to heat transfer. The interior of the container on each part thereof contains an envelope containing the freezable gel which is sealed and made of a stiff plastic material which generally holds its form even when the gel therein is unfrozen. The envelope on each side is spaced from the interior wall of the outer casings in both instances to provide an air barrier within which moisture within the barrier has been removed to the maximum extent possible. The gel within the frozen envelopes can be placed in a frozen state by various methods. The two portions of the container may be joined together either by a hinged element along one side of the corresponding locking mechanism on the opposite side or by a plurality of locking mechanisms on at least two opposite sides of the container.

7 Claims, 7 Drawing Sheets

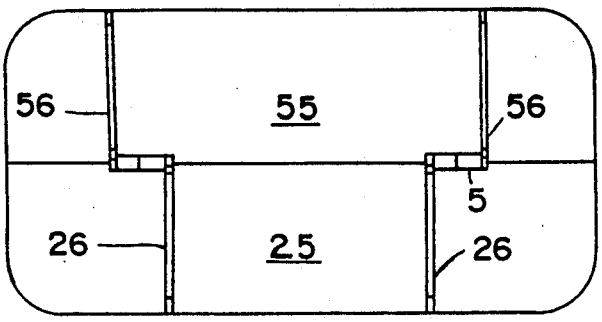
FIG 3
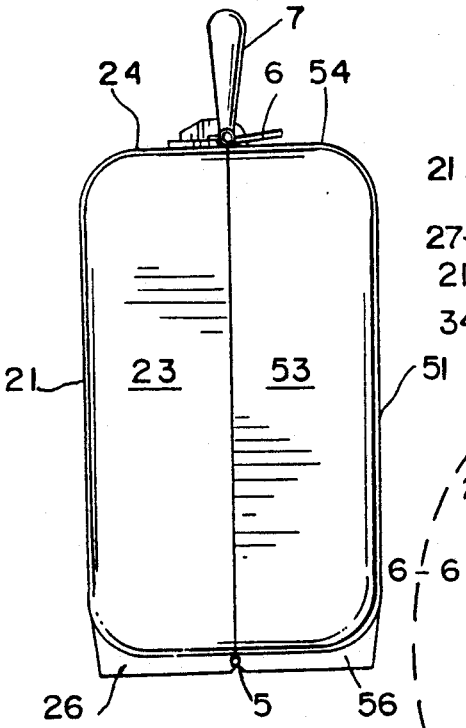
FIG 4
FIG 5
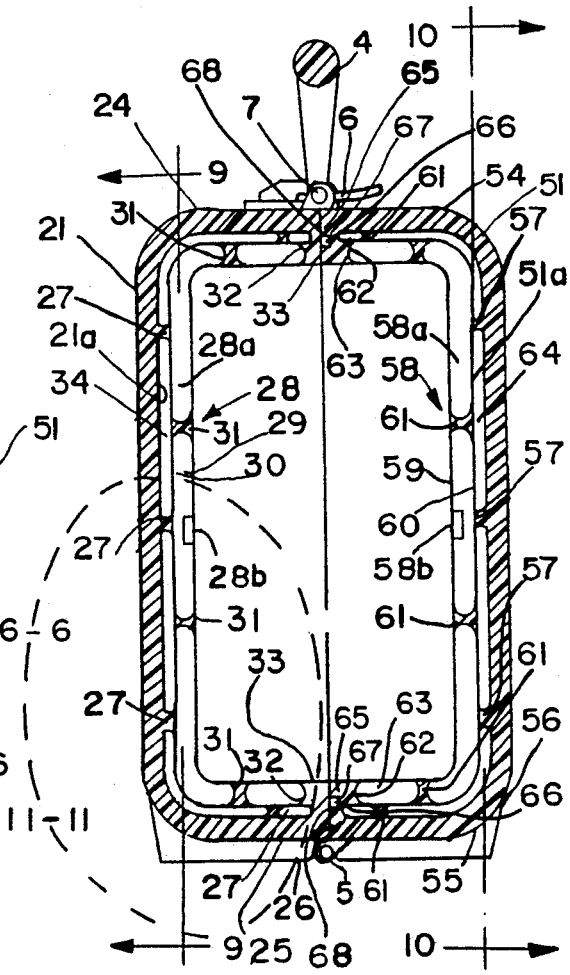

PORTABLE CONTAINERS FOR MAINTAINING FOOD STUFFS IN A CHILLED CONDITION

FIELD OF INVENTION

The present invention is in the field of portable containers referred to generally as ice chests. More specifically, the present invention is in the field of such portable containers which utilize a gel which can be frozen to provide the chilling temperatures to preserve food stuffs and protect them from the growth of bacteria.

BACKGROUND OF THE INVENTION

The use of portable food chests for carrying foods which have been previously prepared or will be prepared at a site has long been practiced, and in the initial stages utilize the chest into which pieces of ice were placed and the food stuffs were placed on top of it. The purpose of such containers is to attempt to maintain perishable goods at temperatures which prevent expotential bacterial growth and to keep liquids at a more pleasant temperature. One disadvantage of this is that the ice melted and the chest collected water which, in time, could cause absorption of liquid in the food stuffs being protected. To prevent this from happening, use has been made of dry ice as it is referred to, which of course, evaporates when exposed to air but does provide a chilling temperature. This has certain disadvantages because in certain situations it is possible that the food stuffs could be reduced to a temperature lower than intended, perhaps in some instances, almost amounting to freezer burn. To overcome this, use has been made of ice cubes which can be purchased in bag form and placed in the container and the food stuffs placed on top of it. These ice bags do provide the reduced temperatures which are helpful, but again the ice is subject to melting, and in most instances, the water leaks out of the bag. To overcome this, there have been developed and sold containers which, for example, are of rather rigid plastic, but into which water can be placed and the container secured, the container then being placed in a freezing area such as the freezer of a refrigerator, and the water therein reduced to ice. This eliminated the problem of melting and water within the container. Recently, there have been a more pronounced use of bags of a suitable type gel-like material enclosed in plastic bags, which can be frozen, and which, of course, again eliminate the problem of water resulting from the melting. The gel compounds are of many types and commonly known, and, for example, can be composed of a mixture of borax or boric acid with an emulsion in which polyvinyl acetate is dispersed in polyvinyl alcohol. The containers as mentioned above take several forms, the simplest one being a container molded of thermoplastic such as polystyrene with reasonably good insulating qualities and is light in weight. It has the disadvantage in that the container is not resistant to shock and can be easily chipped or broken merely by unfortunate contact from dropping or striking a sharp-pointed object. There are also containers which are either of a rigid plastic interior and exterior or metal exterior and plastic interior having sandwiched therein a thermoplastic insulation. Again, these latter containers are perhaps more subject to heat transfer simply because the outer wall of the container normally is more transmissive of the heat of the ambient atmosphere and increases the tendency for the interior temperature to rise. The fact that these latter containers are not particularly efficient is that most of them are provided with some sort of a drain because of the fact that any chilling medium other than a packaged gel or rigid container having ice frozen therein will melt and there is a requirement for draining them. The principal deficiency of the presently known containers is the inability to reduce or diminish the transfer of the heat from ambient conditions exterior to the container to the interior of the container which causes an unwanted and increased raising of the temperature of the interior of the container.

SUMMARY OF THE PRESENT INVENTION

The present invention comprises a container having a top and bottom or two-part form, the outer shell of the container is made of a shock-resistant thermoplastic material having a maximum possible deterrent to heat transfer. The interior of the container on each part thereof contains an envelope containing the freezable gel which is sealed and made of a stiff plastic material which generally holds its form even when the gel therein is unfrozen. The envelope on each side is spaced from the interior wall of the outer casings in both instances to provide an air barrier within which moisture within the barrier has been removed to the maximum extent possible. The gel within the frozen envelopes can be placed in a frozen state by various methods. The two portions of the container may be joined together either by a hinged element along one side of the corresponding locking mechanism on the opposite side or by a plurality of locking mechanisms on at least two opposite sides of the container.

DESCRIPTION OF THE DRAWINGS

FIG. 3 is a bottom plan view of the present invention.

FIG. 4 is an elevation view of the right side of the invention as seen in FIG. 1, the left side elevation view being substantially identical.

FIG. 5 is a cross-sectional view of an elevation along the plane 5—5 in FIG. 1.

BRIEF DESCRIPTION OF THE INVENTION

Figure 1:
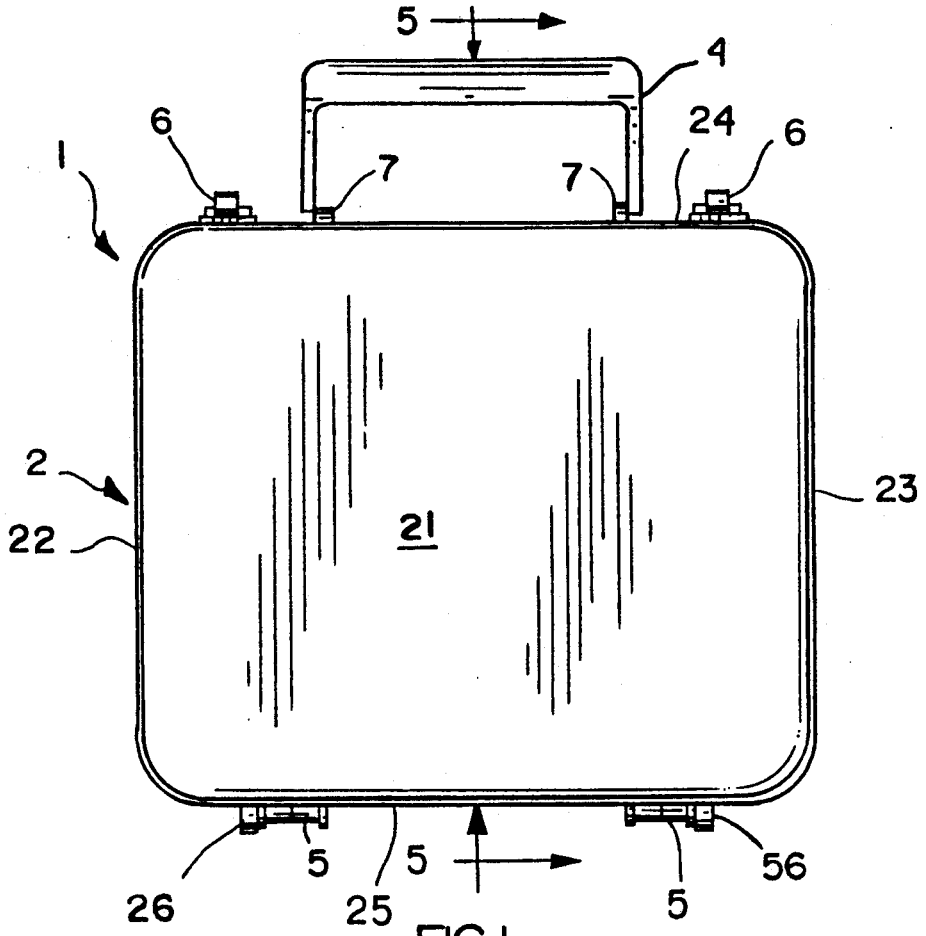
FIG. 1 is a front elevation view of one embodiment of the present invention, the rear view being a mirror image.
Figure 2:
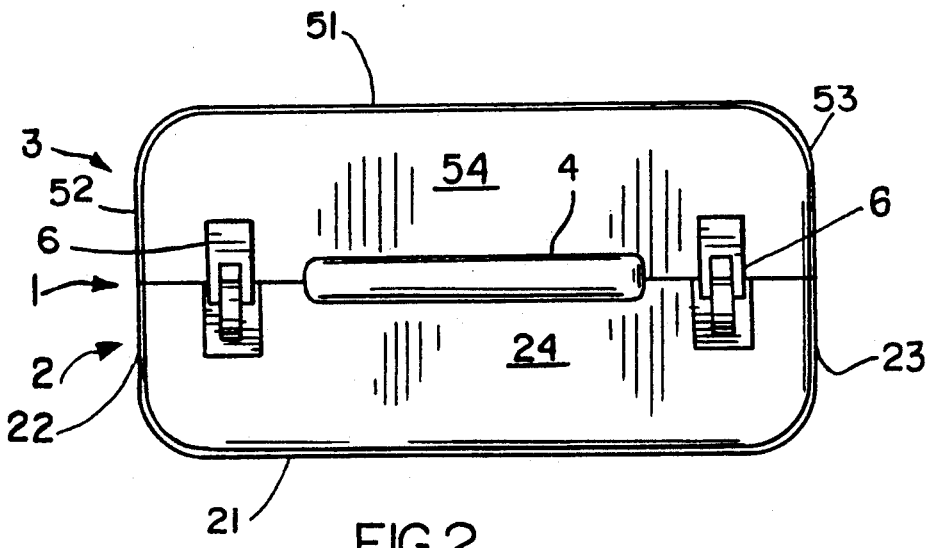
FIG. 2 is a top plan view of the showing in FIG. 1.

Referring now to FIGS. 1-9, the present invention will be seen as a lunch box and to comprise a rectangular container comprising two casings 2 and 3, joined on the lower side by hinged elements 5 and having clasps or locking elements 6 on the upper side. The two casings of the container, 2 and 3, comprise side portions 21 and 51, each casing having an end portion 52 and 53 and 22 and 23 and a bottom portion 25 and 55 and top portion 24 and 54. A handle 4 is mounted on one of the upper sides 24 and 54 by means of hinged elements 7. The bottom portions 25 and 55 are joined together by a hinged element 5, and for stability of the embodiment of the invention shown in these figures there is provided stabilizing ribs 26 and 56. The container casings 2 and 3 are comprised of a highly sharp resistant thermoplastic molecule material which can be subjected to low temperatures without becoming brittle and is even pliable at low temperatures. The interior surfaces 21*a* and 51*a* of the side walls 21 and 51 include a plurality of protrusions 27 and 57 which are formed integrally with the outer casings 2 and 3 at the time of molding. The invention further comprises an inner shell for each of the outer casings 21 and 51, the inner shells 28 and 58 each comprising a sealed unit, each having two spaced apart walls 29 and 30, 59 and 60 within which walls there are spacers 31 and 61 which maintain the walls 29 and 30, 59 and 60 in a spaced apart relationship. The inner shell is filled with a gel such as described before which gel is inserted into the inner shells 28 and 58 through a one-way opening or valve 28*b* and 58*b*. The inner shells are secured to the protrusions 27 and 57 on the inner surface of the outer casings 2 and 3, thereby providing air spaces 34 and 64 between the inner shells 28 and 58 and the outer casings 2 and 3. The inner shells 28 and 58 comprise two spaced apart components 29 and 30 and 59 and 60 which are maintained in a spaced apart relationship by spaces 31 and 61. The inner shells 28 and 58 are comprised of a rigid thermoplastic material which maintains its illustrated form even under conditions of the freezing of a gel, the shells not being substantially deformed. The quantity of gel inserted into the inner shells 28 and 58 is such that when the gel is in a frozen condition there is no tendency to expand the shell. The walls of the inner shells 28 and 58 are completely closed units as is seen in the drawings and are fitted into recesses 33 and 63 which are formed within the interior edges of the outer casings 2 and 3 as seen at 32 and 62.

FIGS. 5-10 illustrate the distinguishing features of the present invention over the known prior art. As pointed out previously, the present invention discloses inner shells 29 and 58 with outer casings 2 and 3. Inner shells 28 and 58 are spacedly positioned from the inner surfaces of their respective outer casings 2 and 3 by a plurality of protrusions 27 and 57 which are integrally molded on the inner surfaces of casings 2 and 3. Inner shells 28 and 58 are adhered to their respective protrusions thereby forming a sealed air barrier chamber 34 and 64 between the inner walls 30 and 60 of their respective inner shells 28 and 58 and the inner surfaces 21*a* and 51*a* of outer casings 2 and 3. These air barrier chambers function as insulation against such ambient exterior temperatures as may penetrate the exterior walls of the aforementioned heat transmission resistant thermoplastic material from which the outer casings 2 and 3 are formed. The insulative quality of air barrier chambers 34 and 64 is enhanced by removal to the maximum extent possible of any moisture in the air within these chambers when they are formed by placing inner shells 28 and 58 into secured position with protrusions 27 and 31. Moisture removal can be accomplished by use of dessicants or similar well known means such as are employed in construction of multiple pane windows.

Figure 7:
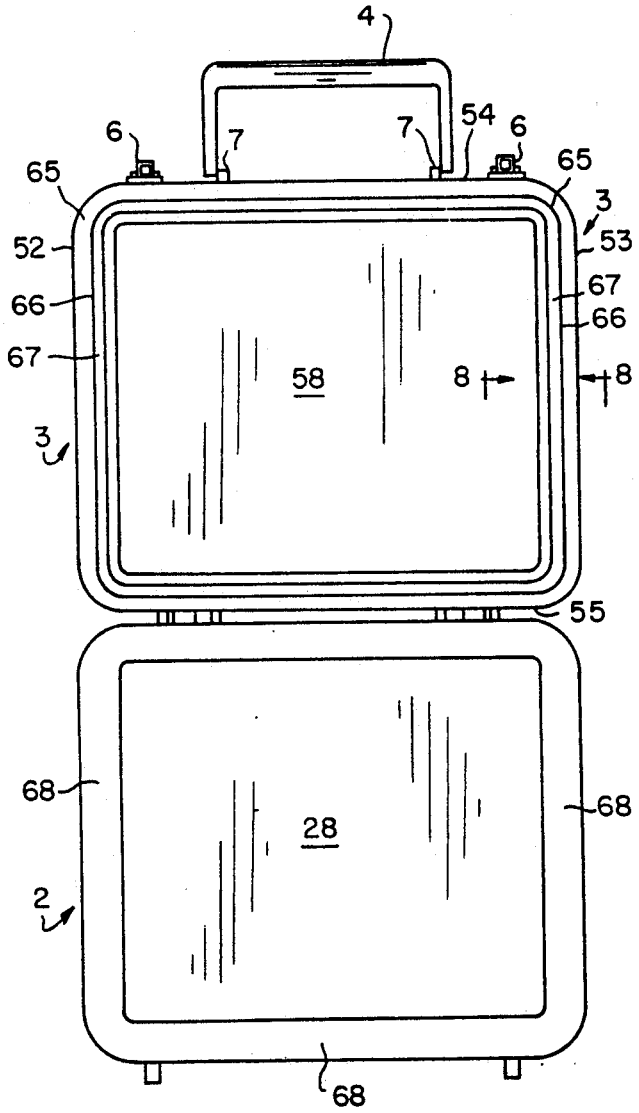
FIG. 7 is a top plan view of FIG. 1 in a fully opened position.
Figure 6:
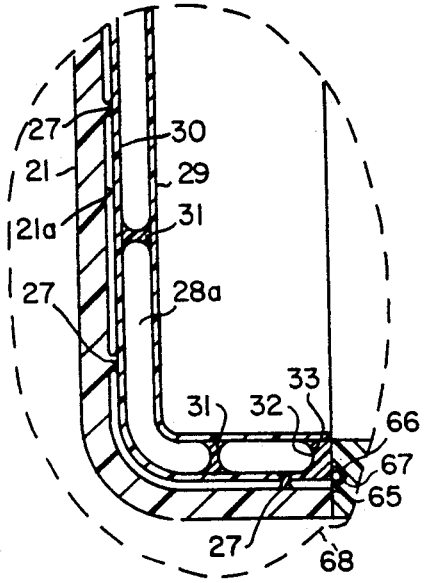
FIG. 6 is a cross-sectional view of the plane 6—6 as shown in FIG. 5.

As seen from the drawings and previously described, the inner shells 28 and 58 are formed as sealed casings having spaced apart interior walls 30 and 60 which are spaced from the exterior walls 29 and 59 by a plurality of spacers 31 and 61, the spacers being secured to their respective interior and exterior walls by any of variously known elements thereby forming cavities 28*a* and 58*a*. Referring to FIGS. 6 and 7, walls 29 and 30 terminate in closed ends 32 which are inserted into recesses 33 in the interior of surfaces 68 on casing 2. Walls 59 and 60 terminate in closed ends 62 while inserted into grooves 63 in the interior of surfaces 65 of casing 3. The adherence of walls 30 and 60 to protrusions 27 and 57 and the insertions of inner shell ends 32 and 62 into grooves 33 and 63 insures the casings will be retained within the respective outer casings 2 and 3. The walls 29 and 30 and 59 and 60 are of a thermoplastic material which has properties of being rigid in ambient temperatures and remains maleable when subjected to freezing temperatures. The cavities 28*a* and 58*a* are filled with a gel such as previously described through one-way ports 28*b* and 58*b* in such quantity that in a frozen state will not cause distortion of walls 29 and 30 and 59 and 60.

The sealing of the interior of the container 1 in the closing of casings 2 and 3 is accomplished by the provision of a sealing element in one of the casings. As seen in FIGS. 6 and 7, the sealing element is in casing 3. The interior surface 65 of casing 3 has a peripheral groove 66 formed therein. Inserted in groove 66 is an elastomeric hollow tubing 67. The opposing surface 68 of casing 2 is flat thus compressing tubing 67 when the container 1 is closed and secured by latches 6 and sealing the container.

As stated in the beginning of the description the embodiment shown in FIGS. 1-10 is a lunch box. To prepare the container for maintaining the contents in a cooled condition to prevent development and growth of bacteria, the container is placed in a freezing unit in the open position seen in FIG. 7. The gel in the chill casings 28 and 58 includes the property of rapid temperature reduction to a solid state and reduced rate of absorption of heat, thereby maintaining the low temperature for a longer period of time. When the gel is in a solid state the container is removed from the freezing unit, the food placed therein and the container closed. As described above, the thermoplastic forming the outer casings 2 and 3 has a maximum resistance to transmission of heat therethrough. This property also reduces the transfer of heat from the casings when the container is placed in a freezing unit so that when the container is removed from the freezing unit into ambient conditions, there is a marked reduction, or possibly elimination, of the condensation of moisture in ambient air on the surfaces of the container.

Figure 8:
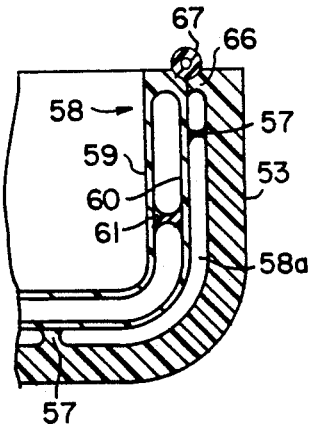
FIG. 8 is a cross-sectional view along the plane 8—8 in FIG. 7.
Figure 9:
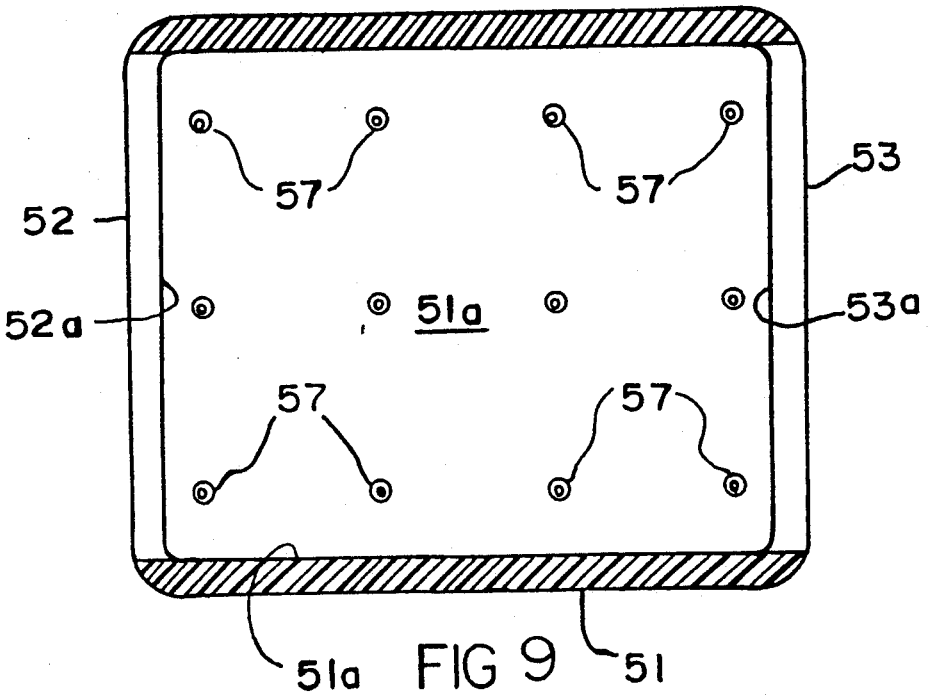
FIG. 9 is an elevation view in cross-section along the plane 9—9 in FIG. 5.
Figure 10:
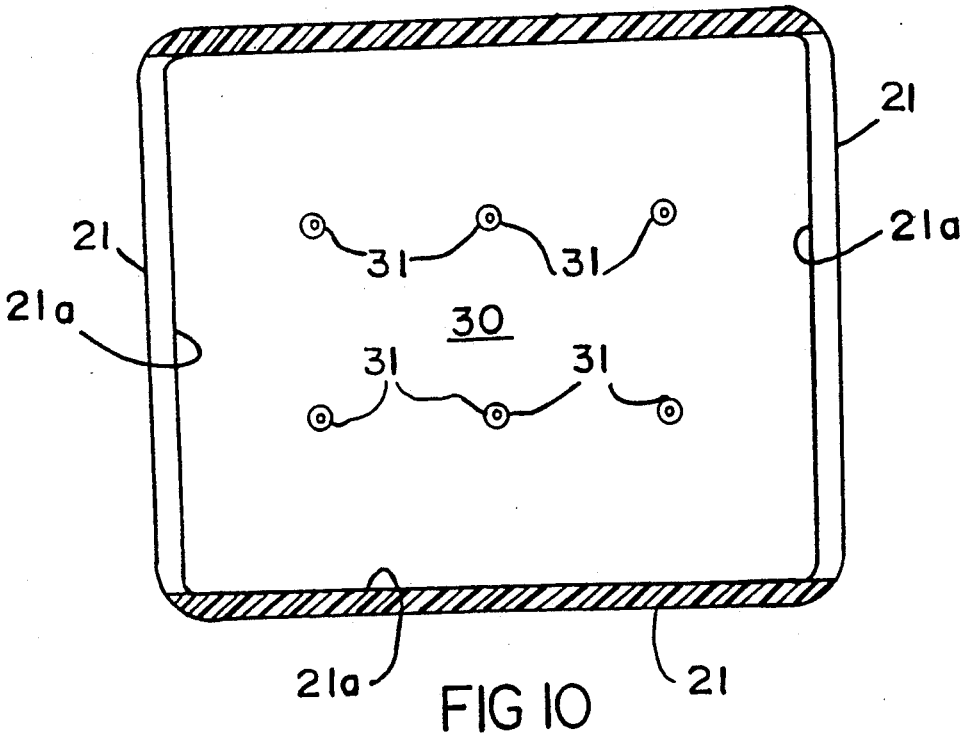
FIG. 10 is an elevation view in cross-section along the plane 10—10 in FIG. 5.
Figure 13:
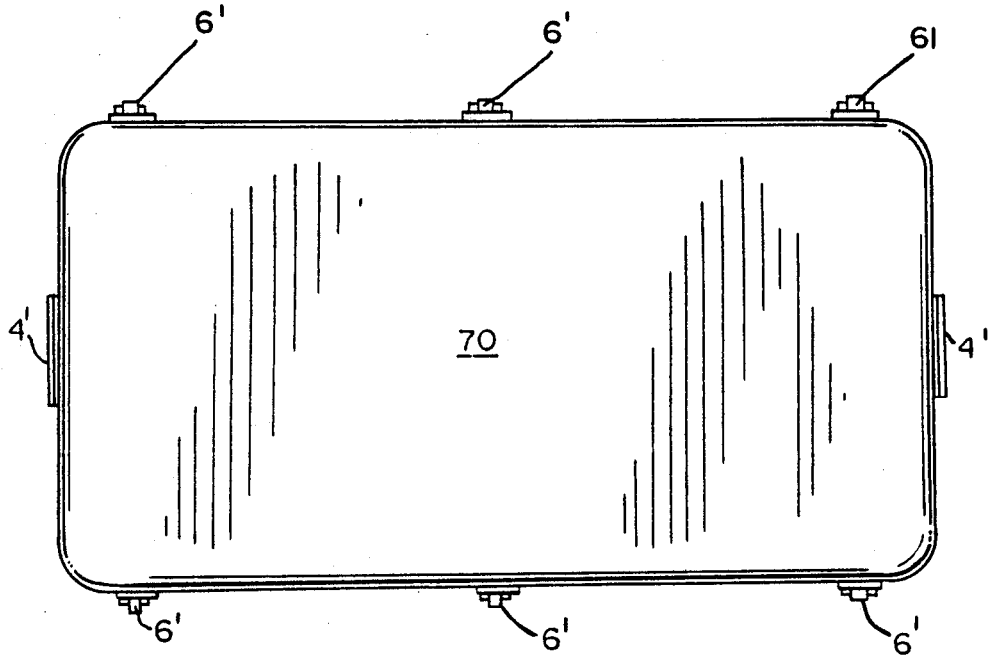
FIG. 13 is a top plan view of FIG. 12, the bottom view being a mirror image.
Figure 11:
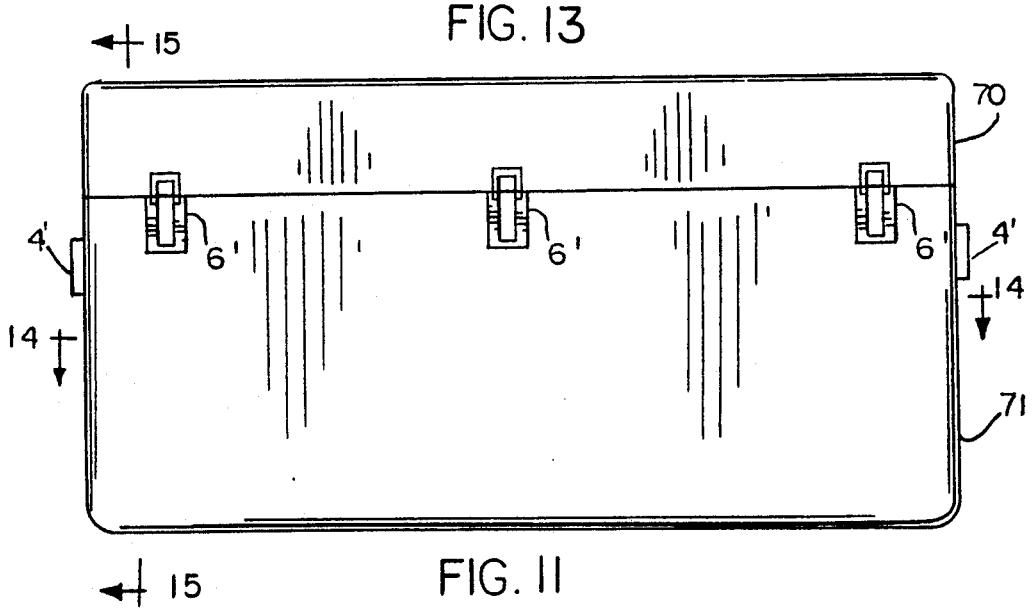
FIG. 11 is a front elevation view of another embodiment of the present invention, the rear view being a mirror image.
Figure 12:
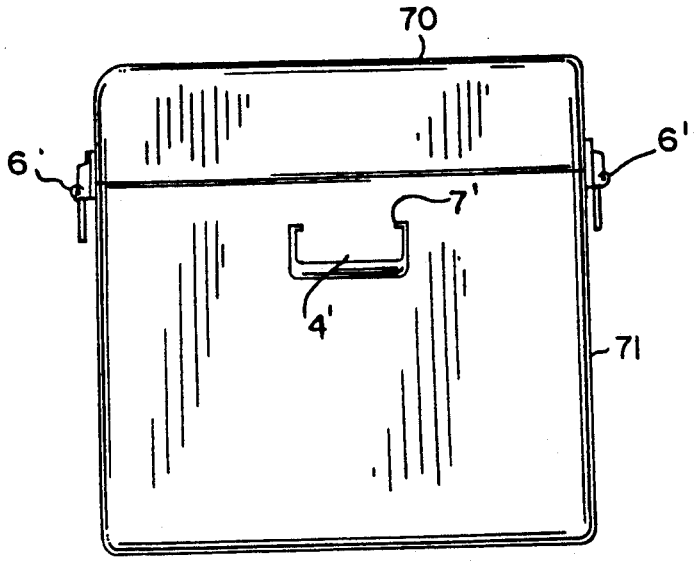
FIG. 12 is an elevation view of one end of FIG. 12, the opposite end being a mirror image.
Figure 14:
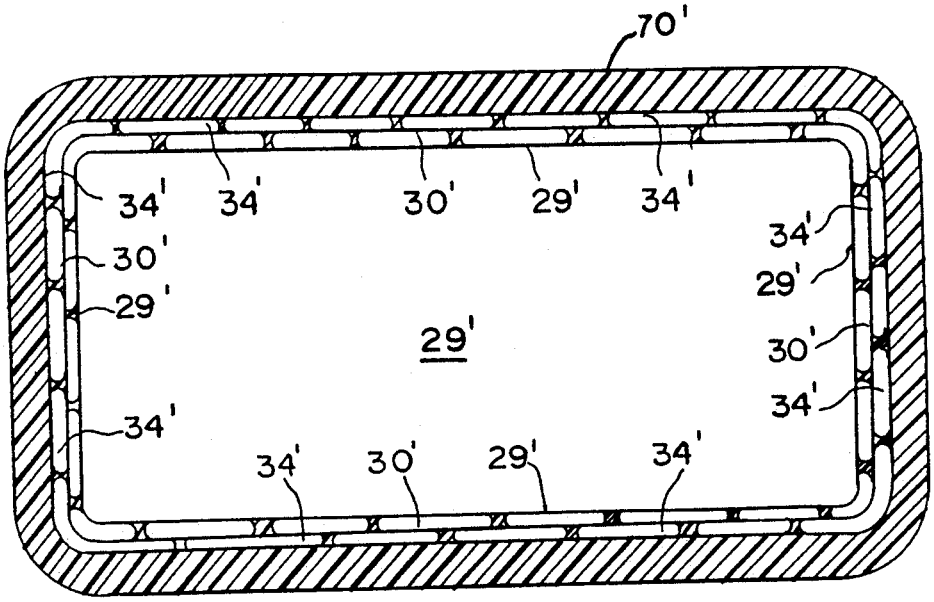
FIG. 14 is a top plan view of the interior of the embodiment seen in FIG. 11 along the plane 14—14 in FIG. 11.

The second embodiment of the present invention as seen in FIGS. 11-14 is a container for use in commerce for transport of seafood, fresh meats or other products requiring reduced temperatures to maintain freshness, i.e., cut flowers. As seen in the FIGS., the container comprises a bottom casing 71 and a top casing 70. The two casing portions 70 and 71 are secured together by a plurality of locking elements 6' on at least two opposing sides as shown. Handles are provided on the opposing ends of the bottom casing. The sealing elements in FIGS. 7 and 8 are identical in the sealing required in this embodiment.

The two embodiments differ in size but the principles of the invention as shown and described with reference to FIGS. 1-10 are equally applicable to FIGS. 11-14, which comprise outer casings, an air barrier and inner shells. For simplicity, the detailed description of the elements in FIGS. 11-14 common with the elements shown and described with reference to FIGS. 1-10 will not be repeated but will be identified with the same reference numerals to which a prime (') has been added and such reference for understanding should be made to the detailed description for FIGS. 1-10. It is evident that the required cooling of the chilling casings in FIGS. 11-14 can be accomplished by placing the container of FIGS. 11-14 inside commercial size freezers.

Figure 15:
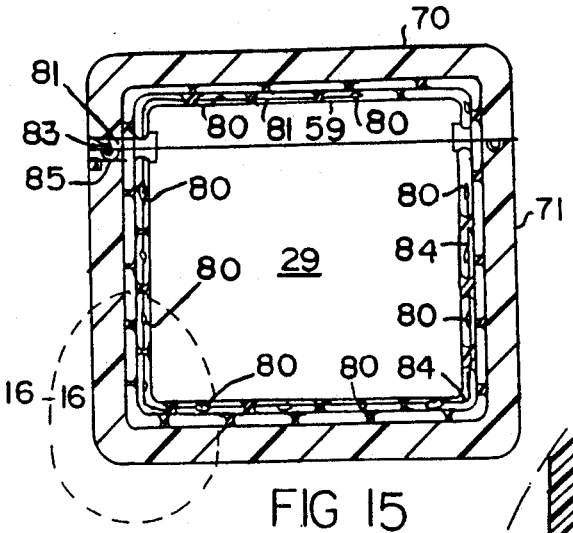
FIG. 15 is an elevation view in cross-section along plane 15—15 in FIG. 11.
Figure 16:
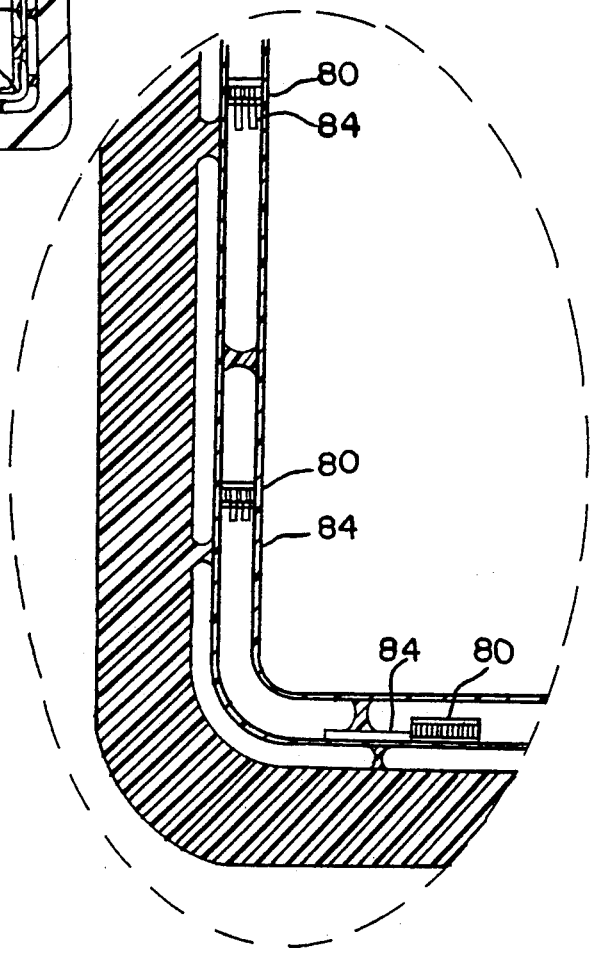
FIG. 16 is an elevation view in cross-section along the plane 16—16 in FIG. 15.

FIGS. 15-16 disclose an alternate embodiment employing the containers and inner shells shown and described with reference to FIGS. 11-14. This embodiment negates the need to place this container in a freezing unit to solidify the chilling casing, and makes it possible to provide a unit for family use. This embodiment uses a plurality of tiny semi-conductor units within the inner shells casings employing the piezzo-electricity principle to freeze the gel. Such units may be of the type employed by A.G.V. s.p.a. of Italy in a motorcycle helmet or by Howard L. Johnson in U.S. Pat. No. 3,295,522 or as may be developed in the current or future state of such art. Only the use of such elements is a part of this invention.

As seen in FIGS. 15-16, a plurality of these units 80 are placed within the inner shell 58 of top casing 71 and are connected in parallel by conductors 81. These conductors terminate in a female plug 83 in casing 71. Similarly, a plurality of these units are placed within the inner shell 28 of bottom casing 70 and likewise connected in parallel by conductors 84. These conductors terminate in a female plug 85 in casing 70. These plugs are of the type well known in the art when it is desired to use single, dual conductor male plugs.

Such modifications of the shape and size of the components of the present invention as illustratively shown and described as may occur to those of skill in the art are encompassed by the scope of the following claims.

What is claimed is:

1. A portable container for maintaining food stuffs at a temperature sufficiently low enough to prevent expotential growth of bacteria comprising: two partible exterior casings with means to secure them together, means to seal said casings when joined together against entrance of ambient temperature and dissipation of said joined together casing interior temperature and means on the exterior of one of said casings to carry said container; each of said casings having an inner double-well shell positioned within each said casing in a spaced relationship with each said casing interior surface by means of a plurality of protrusions extending inwardly from each said interior surface, each said shell being adhered to its respective protrusions to form a closed, air tight chamber between said inner surface and said shell as a barrier against transmission of heat exterior to said casing to said shell; each of said shells between a gel-like substance having one property of becoming a solid when subjected to low temperature and and another property of minimal expansion when in a solid state.

2. The container according to claim 1 wherein each casing comprises joined together bottom, side and end surfaces forming an open interior, said side and end surfaces having a peripheral, inwardly extending lip with a planar surface perpendicular to said side and end surfaces, said planar surface on one of said casings having a peripheral groove therein, said groove containing a continuous tube of resilient material which remains flexible at low temperature; said planar surface of said other casing compressing said tube to form said sealing means.

3. The container according to claim 2 wherein a peripheral groove is formed in each said planar surface underside at juncture of said underside and said casing interior surface, each said groove receiving and retaining said inner shell peripheral and edge.

4. The container according to claim 3 wherein said inner shell has a configuration matching said casing inner configuration and comprises a pair of parallel, spaced apart sheets of a stiff thermoplastic forming bottom, side and end walls, a plurality of spacers between said sheets, the inner surfaces of said sheets being adhered to said spacers, said side and end wall ends being closed to form a sealed inner shell and self-sealing means on the outer sheet for injection of a predetermined quantity of said gel.

5. The container according to claim 1 wherein said casings are molded from a material having high tensile and compressive strengths, remaining maleable at low and high ambient temperatures and minimal index of heat transmission.

6. The container according to claim 1 wherein said gel is transformed into a solid state by placing said container in a unit having an interior temperature below freezing.

7. The container according to claim 1 further comprising a plurality of tiny semi-conductor devices employing the piezzo-electricity principle connected in a parallel circuit arranged in a predetermined pattern within each said inner shell to transform said gel into a solid state when activated, the devices being secured to the inner surface of at least one of said double walls of said inner shell, said circuit having a terminal in the outer surface of each casing.

* * * * *